US005857944A

United States Patent [19]

Cone et al.

[11] Patent Number: 5,857,944

[45] Date of Patent: Jan. 12, 1999

[54] STATIONARY BABY JUMPER

[75] Inventors: Richard E. Cone, Athens, Ohio; Michael S. Rosko, Greenwood, Ind.

[73] Assignee: Cosco, Inc., Columbus, Ind.

[21] Appl. No.: 556,018

[22] Filed: Nov. 9, 1995

[51] Int. Cl.[6] ..... A61H 3/00; A47D 13/04; A63B 22/00

[52] U.S. Cl. ..... 482/66; 482/69; 482/121; 297/274

[58] Field of Search ..... 482/24, 27, 43, 482/66–69, 121, 907; 297/274, 285, 289, 291–293, 296; 403/220, 291; 128/869

[56] References Cited

U.S. PATENT DOCUMENTS

| | | | |
|---|---|---|---|
| D. 262,394 | 12/1981 | Hain | 482/43 X |
| D. 302,360 | 7/1989 | Riehm . | |
| D. 347,121 | 5/1994 | Harper et al. . | |
| D. 355,939 | 2/1995 | Meeker et al. . | |
| D. 360,905 | 8/1995 | Meeker et al. . | |
| 517,403 | 3/1894 | Bradish et al. . | |
| 1,557,263 | 10/1925 | Millen | 297/274 |
| 2,672,916 | 3/1954 | Kenney | 297/274 |
| 3,747,596 | 7/1973 | Mills | 128/869 |
| 4,045,045 | 8/1977 | Boucher et al. . | |
| 4,084,273 | 4/1978 | Haynes . | |
| 4,231,582 | 11/1980 | Moss . | |
| 4,359,242 | 11/1982 | Gerken et al. . | |
| 4,733,861 | 3/1988 | Plunkett | 482/126 |
| 4,830,345 | 5/1989 | Mar . | |
| 5,205,803 | 4/1993 | Zemitis | 482/121 |
| 5,352,057 | 10/1994 | Zody | 482/17 |
| 5,407,246 | 4/1995 | Meeker et al. . | |
| 5,499,949 | 3/1996 | Heubl | 297/274 X |

OTHER PUBLICATIONS

Target the Family, p. 27, (1995), G + J Custom Publishing, 110 Fifth avenue, 9th Floor, New York, NY 10011.

*Primary Examiner*—Richard J. Apley
*Assistant Examiner*—Denise Pothier
*Attorney, Agent, or Firm*—Barnes & Thornburg

[57] ABSTRACT

A stationary baby jumper apparatus is provided. The jumper apparatus includes a support frame having a U-shaped base leg with upstanding ends. A cantilevered seat-support leg is mounted upon the upstanding ends of the U-shaped base leg. A chair seat is suspended from the seat-support leg. Connectors are provided and are positioned in spaced-apart relation to one another about the cantilevered seat-support leg. The chair seat is suspended from the seat-support leg by shock cords that extend between the chair seat and the connectors. Each shock cord includes a first end coupled to a respective connector, a second end coupled to the frame of the chair seat, and an extensible center portion extending between the first and second ends.

57 Claims, 2 Drawing Sheets

STATIONARY BABY JUMPER

BACKGROUND AND SUMMARY OF THE INVENTION

This present invention is directed to a jumper for small children, more particularly to a stationary jumper for small toddlers or babies. Most particularly, the present invention is directed to a seat suspended by elastomeric materials on a cantilevered frame so that a child in the seat is able to bounce and exercise.

There are a wide variety of apparatus available today in which children may be placed for exercise. Similarly, there are a wide variety of devices available today in which children may be placed for entertainment. Some of these devices are expandable to several positions so that the distance to the ground from the seat may be controlled for different sized children. See for example, U.S. Pat. No. 4,359,242 to Gerken et al. Some devices also have a resiliently supported child seat positioned above the ground. See, for example, U.S. Pat. No. 4,231,582 to Moss. Moreover, child exerciser/rockers are available. See for example, U.S. Pat. No. 5,407,246 to Meeker et al.

Despite the number of efforts to meet the needs of caregivers for exercise and entertainment of young ones, there remains a need for a jumper that has a support frame which remains substantially still on a floor surface, that is adjustable to one of several expanded positions, and that has an easy access seat portion suspended within the support frame.

According to the present invention a stationary baby jumper apparatus is provided. The jumper apparatus includes a support frame having a U-shaped base leg with upstanding ends, a cantilevered seat-support leg mounted upon the upstanding ends of the U-shaped base leg, and a chair seat suspended from the seat-support leg. In addition, connectors are provided which are positioned in spaced-apart relation to one another about the cantilevered seat-support leg. The chair seat is suspended from the seat-support leg vertically above the base leg by shock cords that extend between the chair seat and the connectors. Each shock cord includes opposite ends and an extensible center portion extending between the opposite ends. One end of each cord is coupled to one connector and the opposite end of each cord is coupled to the frame of the chair seat.

In preferred embodiments of the present invention, the connectors include a circular sleeve portion and an opposite gripping portion. The seat-support leg extends through the sleeve portion of each connector to securely fastened them onto the support frame. Moreover, the first end of the shock cord extends through the gripping portion and forms a bulb within the connector to prevent sliding movement of the cord out from the gripping portion. Further, the second end of the shock cord extends into the chair seat and forms a second bulb therein to prevent sliding movement of the cord from the seat.

In yet another embodiment of the present invention, the seat frame is formed so that the height of the chair may be raised or lowered to accommodate different sizes of children. Preferably, the seat-support leg is mounted within the upstanding ends of the base leg and a spring-loaded adjustment mechanism is positioned within the seat-support leg so that it may be raised or lowered with respect to the base leg. The adjustment mechanism includes a U-shaped spring having a locking tab extending outwardly from one end of the spring. The seat-support leg, which houses the spring, includes a hole through which the locking tab extends. In addition, the upstanding ends of the base leg include at least two holes therein which are aligned with the locking tab. Therefore, to adjust the positioning of the seat-support leg, the caregiver must simply push the locking tab into the hole and slide the seat-support leg toward a desirable predetermined position. Once the locking tab reaches the predetermined position, it automatically springs back through the hole with which it is aligned to secure the seat-support leg in its new locked position.

From a manufacture's perspective, a stationary baby jumper in accordance with the present invention is preferable over traditional jumpers because the jumper's shape allows for fast and inexpensive tooling. The use of extensible shock cords also eliminates the need to improve the general appearance of exposed springs by expensive plating and finishes. Moreover, it is easy to paint the support frame to any desirable color.

A user of a stationary baby jumper in accordance with the present invention will also find that a jumper in accordance with the present invention is preferable over traditional jumpers. The support frame remains in a stationary position on the floor making it easier to use than traditional jumpers. Furthermore, the chair seat of the baby jumper is readily accessible to the caregiver because it is suspended within a cantilevered seat-support leg.

Additional objects, features, and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
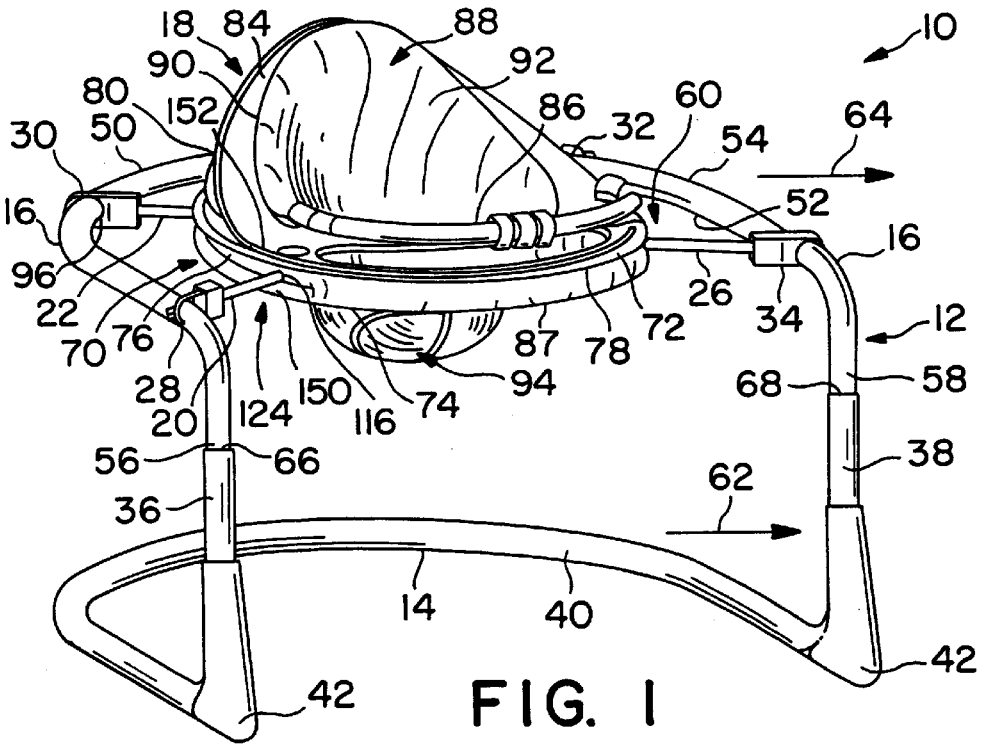
FIG. 1 is a perspective view of a stationary baby jumper having base leg, a cantilevered seat-support leg mounted on the base leg, a chair seat which includes a frame and a seating portion situated within the frame, connectors positioned in spaced-apart relation about the seat-support leg, and extensible cords extending between each of the connectors and the frame of the chair seat.

A stationary baby jumper apparatus 10 in accordance with the present invention is shown in FIG. 1 as it would appear to a caregiver after it has been placed upon a surface (not shown). The apparatus 10 remains in a substantially stationary position on the surface making it easy for a caregiver to use. The jumper apparatus 10 includes a support frame 12 having a base leg 14 and a cantilevered seat-support leg 16 mounted upon and elevated above the base leg 14. A chair seat 18 is suspended from the seat-support leg 16 above the base leg 14 by extensible shock cords 20, 22, 24, 26 which extend from the chair seat 18 to connectors 28, 30, 32, 34 positioned about the seat-support leg 16.

The support frame 12 is formed for secure stationary positioning upon the surface. The base leg 14 of the support frame 12 includes a head portion 36, an opposite foot portion 38, and a shaft 40 interconnecting the head and foot portions 36, 38. Preferably, stabilizers 42 are affixed to both the head and the foot portions 36, 38 with mounting screws 44 as shown, for example, in FIG. 5. Referring again to FIG. 1, the head portion 36 is positioned in a spaced-apart relationship relative to the foot portion 38. The seat-support leg 16 interconnects the head portion 36 and the foot portion 38 of the base leg 14. Moreover, the base leg 14 is formed to include a central aperture 46 therein that has a cross-section sized for insertion and mounting of the seat-support leg 16 therein. The seat-support leg 16 is fixed in place within the central aperture 46 using a mounting apparatus 48. It is understood that the seat-support leg 16 could be mounted in the central aperture 46 using either a pin, rivet, rod, adhesive, or comparable mounting means.

Figure 2:
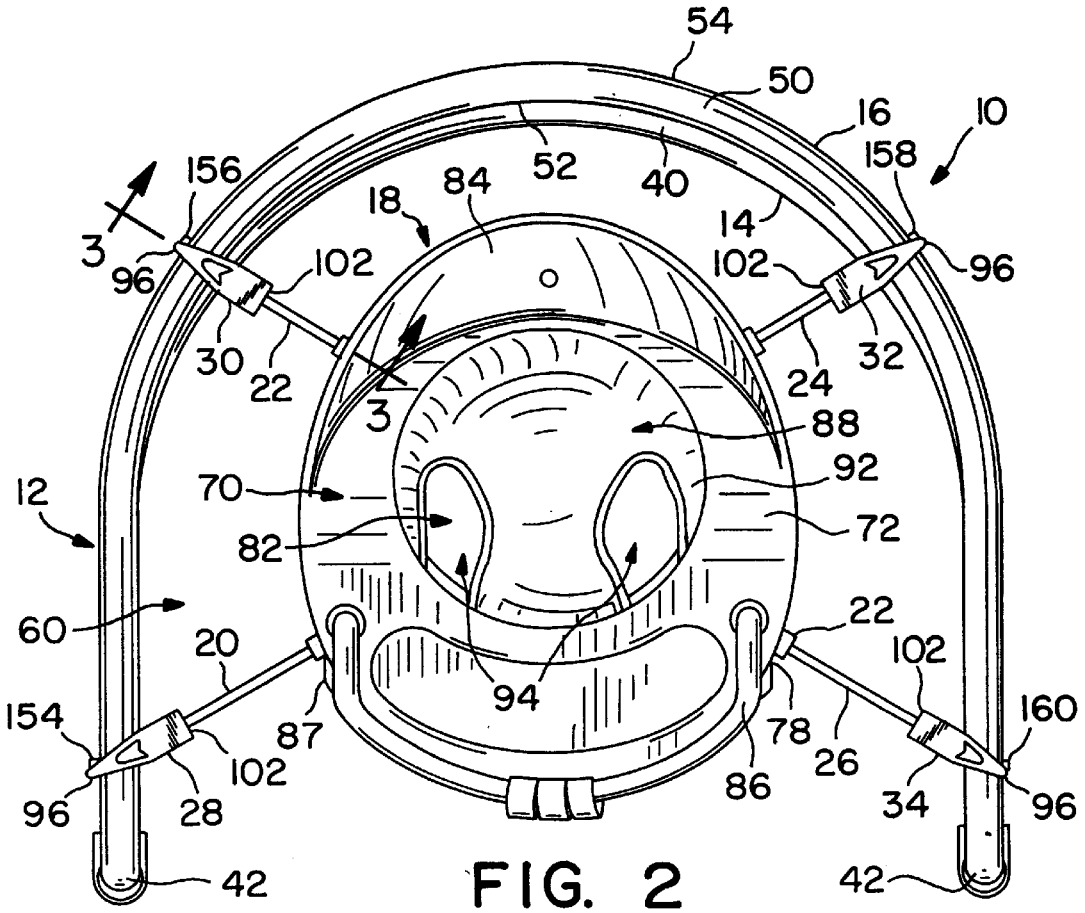
FIG. 2 is a top view of the baby jumper of FIG. 1 showing the relative positioning of the connectors on the seat-support leg and the extensible cords extending between the frame of the chair seat and the connectors mounted on the seat-support leg.

The seat-support leg 16 as shown in FIGS. 1 and 2 has a CURVED SHAFT 50 portion with a concave side 52 arranged to face the respective head and foot portions 36, 38 of the base leg 14 and an opposite convex side 54. The seat-support leg 16 includes opposite end portions 56, 58 and the CURVED SHAFT 50 portion extends between the opposite end portions 56, 58. The end portions 56, 58 are positioned in a spaced-apart relation to one another so that a seat-receiving space 60 is formed therebetween. It is understood that the seat-support leg 16 may be formed in a variety of shapes so long as it interconnects the head and foot portions 36, 38 of the base leg 14 and forms the seat-receiving space 60. In particular, it is understood that the opposite ends portions 56, 58 of the seat-support leg 16 maybe formed for mounting the head and foot portions 36, 38 of the base leg 14 therein.

The shaft 40 of the base leg 14 lies in a first substantially horizontal plane 62 and the seat-support leg is elevated to lie in a second plane 64 vertically above and substantially parallel to the first plane 62. Each of the head and foot portions 36, 38 have upstanding ends 66, 68 extending vertically above the first plane 62. Preferably, each of the head and foot portions 36, 38 extend vertically upward from the first plane 62 toward the second plane 64.

As shown in FIG. 1, the chair seat 18 has a frame 70 which lies generally in the seat-receiving space 60 in the second plane 64 when stationary. The frame 70 is generally circular in shape and includes an outward side 72, an inward side 74, and an outer edge 76 extending about the periphery of the frame 70. Moreover, the frame 70 includes a front side 78 facing the end portions 56, 58 of the seat-support leg 16, an opposite back side 80 facing the concave side 52 of the seat-support leg, and an aperture 82 extending between the outward and inward sides 72, 74 of the frame 70. Preferably, the aperture 82 is sized to receive a child therein. In addition, a back support portion 84 is positioned on the back side 80 of the frame 70 and an activity bar 86 is positioned on the front side 78 of the frame 70. Both the back support 84 and the activity bar 86 extend outwardly away from the outward side 72 of the frame 70. Moreover, a bumper 87 preferably extends along the outer edge 76 of the front side 78 of the frame 70.

Figure 3:
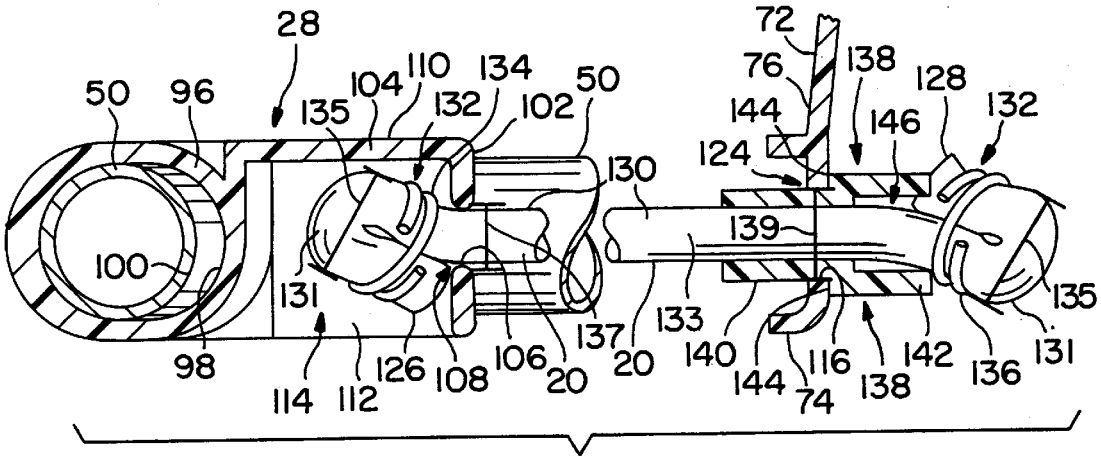
FIG. 3 is a view taken along lines 3—3 of FIG. 2 showing the extensible cord having opposite ends each forming a bulb and the bulbs are mounted within the connector and the chair seat respectively.

The chair seat 18 preferably includes a fabric seat 88 having a border portion 90 and an interior portion 92. As shown in FIGS. 1 and 3, the border portion 90 is preferably coupled to the inward side 74 of the frame 70 using any one of a wide variety of known coupling methods for fabric seats 88. For example, the frame 70 of the chair seat 18 may be formed to include clips (not shown) on the inward side 74 and the border portion 90 is coupled to the chair seat 18 using these clips (not shown). In addition, the interior portion 92 of the fabric seat 88 is formed to include holes 94 therethrough which are sized and positioned to receive legs of the child (not shown). Preferably, the interior portion 92 of the fabric seat 88 is positioned so that the holes 94 are positioned in spaced-apart relation to one another and face the front side 78 of the frame 70 of the chair seat 18.

Figure 4:
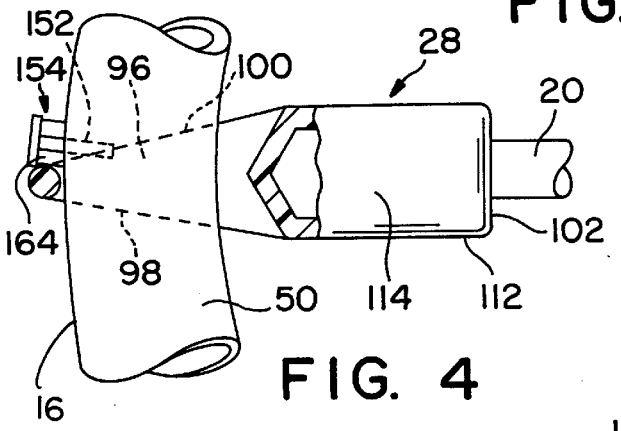
FIG. 4 is a top view the connector of FIG. 3 showing a blocking screw extending through the seat-support leg.

Illustratively, the jumper apparatus 10 includes four connectors 28, 30, 32, 34 which are formed to mount the chair seat 18 in the second plane 64 adjacent the seat-support leg 16 as shown, for example, in FIG. 2. It is understood that greater or fewer than four connectors may be used so long as the frame 70 of the seat chair 18 is securely mounted within the seat-receiving space 60 adjacent the seat-support leg 16. The connectors 28, 30, 32, 34 allow the caregiver to mount the chair seat 18 easily onto the seat-support leg 16 using the shock cords 20, 22, 24, 26. While only the shock cord 20 and connector 28 are illustrated in FIGS. 3 and 4 and discussed hereinafter, it is understood that the connectors 30, 32, and 34 and cords 22, 24, and 26 are similarly formed. The connector 28 is formed to include a sleeve portion 96 having first and second ends 98, 100, an opposite cord gripping end 102, and a center portion 104 extending between the sleeve portion 96 and the gripping end 102. The curved shaft portion 50 of the seat-support leg 16 is formed for extension through the sleeve portion 96, in order to mount the connector 28 on the seat-support leg 16.

Furthermore, the gripping end 102 of the connector 28 has a rim 106 defining an aperture 108 sized to receive the shock cord 20 therein as shown, for example, in FIG. 3. The center portion 104 of the connector preferably includes a top wall 110 and opposite side walls 112 defining a cavity 114 therebetween. Ideally, the cavity 114 is sized to house at least a portion of the shock cord 20 therein. Illustratively, the outer edge 76 of the frame 70 is formed to include a lip 116 (FIG. 3) defining a cord-mounting slots 124 as shown, for example, in FIG. 1. Preferably, each mounting slot 124 is positioned in spaced-apart relation about the outer edge 76 of the frame 70.

As shown in FIG. 3, the shock cord 20 includes opposite ends 126, 128 and an extensible center portion 130 extending between the connector 28 and the chair seat 18. One end 126 of the cord 20 extends through the aperture 108 and past the rim 106 where it is fastened within the cavity 114 of the connector 28 and the opposite end 128 is fastened to the chair seat 18 adjacent the inward side 74 of the frame 70. The opposite ends 126, 128 are each folded back upon the center portion 130 to form a bulb 131 at each end 126, 128. Illustratively, clamping means 132 is preferably positioned at each of the distal ends 126, 128 of the cord 20 so as to attach the ends 126, 128 securely to the center portion 130 so that the bulb has a diameter 135 greater than the diameter 137 of the respective rim 106 and the diameter 139 of the lip 116. Preferably, the cord 20 is an extensible shock cord having a substantially rubber-formed core (not shown) and a fabric cover 133 surrounding the core.

Illustratively, the lamping means 132 at the one end 126 of the cord 20 includes an end clip 134. The end clip 134 is generally a commercially available "hog" clip. However, it is understood that the end could be knotted or glued to form the bulb 131 that has a diameter greater that of the rim 106. In addition other clamping apparatus which hold the cord 20 as the bulb 131 without tearing the fabric cover 133 during vertical bouncing of the chair seat 18 and which prevent the end 126 of the cord 20 from sliding through the aperture 108 could be used in accordance with the present invention.

Continuing to refer to FIG. 3, the clamping means 132 at the second end 128 of the cord includes an end clip 136 and a retaining ring 138. The end clip 136 may be a hog clip as previously described. The retaining ring 138 is generally cylindrical in shape and has one end 140 sized for extension into the mounting slot 124 of the frame 70, an opposite end 142, and a flange 144 positioned therebetween and extending outwardly therefrom. A cord passageway 146 extends through the first end 140 and past the flange 144. The flange 144 is sized to engage the inward side 74 of the outer edge 76 of the frame 70 while the end clip 136 engages the end 142 of the retaining ring 138. Therefore, in operation, the hog clip is coupled to the second end 128 of the cord 20 and engages the end 142 of the retaining ring 138 to prevent the bulb 131 from sliding through the mounting slot 124.

In preferred embodiments of the present invention, the mounting slot 124 is formed as a keyhole to allow selective detachment of the chair seat 18 from the seat-support leg 16 as shown, for example, in FIG. 1. Each keyhole includes a inserting passageway 150 having a width sized to receive the cords 20, 22, 24, 26, but too narrow to receive the retaining ring 138 therein. The keyhole does however include a ring passageway 152 that is sized to receive the end 140 of the retaining ring 138, but not the flange 144.

Four blockers 154, 156, 158, 160 are positioned in spaced-apart relation to one another about the seat-support leg 16. The blockers 154, 156, 158, 160 are positioned through seat-support leg 16 between the connectors 28, 30, 32, 34 to prevent the sleeve portions 96 from sliding toward one another during vertical bouncing movement of the chair seat 18 on the seat-support leg 16. As best shown in FIG. 4, the blocker 154 includes a screw 162 extending through a washer 164 and the seat-support leg 16 respectively.

Figure 5:
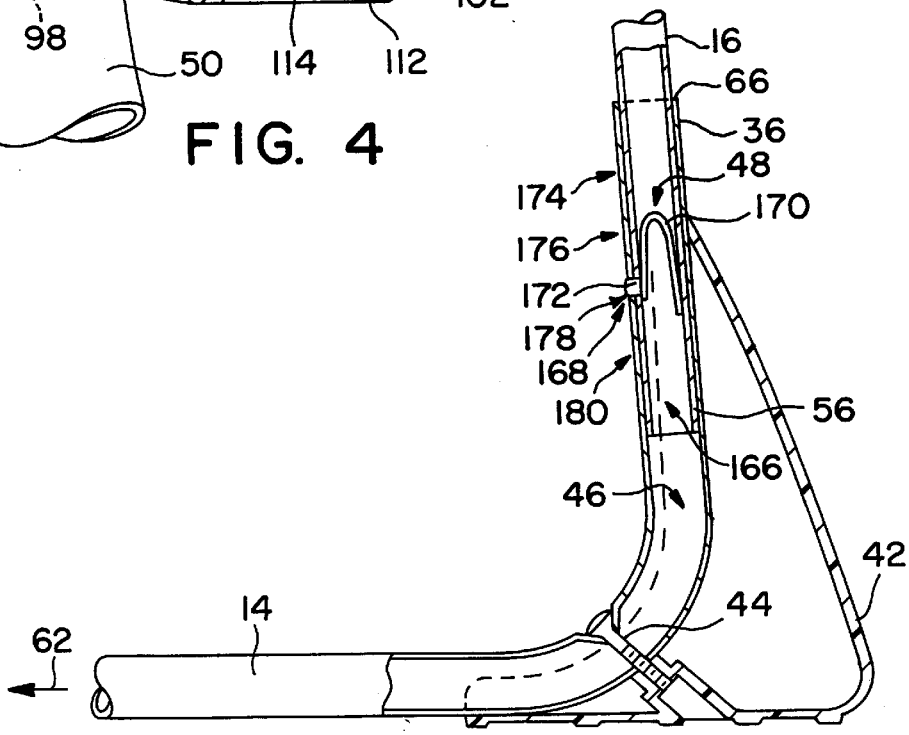
FIG. 5 is a side view of the support frame of FIG. 1, with portions broken away, showing a foot portion of the base leg including an upstanding end and the seat-support leg having one end formed for extension into the upstanding end of the head portion of the base leg, and an adjustment mechanism for selectively setting the vertical elevation of the seat-support leg relative to the base leg.

The mounting apparatus 48 allows the caregiver to adjust the positioning of the seat-support leg 16 relative to the base leg 14. While only the end portion 56 of the seat-support leg 16 and the head portion 36 of the base leg 14 are illustrated in FIG. 5 and discussed hereafter, it is understood that the end portion 58 and foot portion 38 are similarly formed. Referring to FIG. 5, the seat-support leg 16 is formed to include a central aperture 166 having a cross-section sized for insertion of the mounting apparatus 48 therein. Moreover, the end portion 56 is formed to include a locking hole 168 extending into the central aperture 166. Illustratively, the mounting apparatus 48 includes a U-shaped spring 170 having a locking tab 172 extending outwardly therefrom. The spring 170 is biased within the central aperture 166 and normally presses the locking tab 172 through the locking hole 168.

As shown in FIG. 5, both the head portion 36 of the base leg 14 is formed to include a plurality of adjustment holes 174, 176, 178, 180 therethrough. It is understood that greater or fewer than four adjustment holes 174, 176, 178, 180 could extend though the end portions 56, 58. The four adjustment holes 174, 176, 178, 180 of the base leg 14 are positioned in spaced apart relation to one another. The seat-support leg 16 and the base leg 14 are formed so that the locking tab 172 will extend through any of the four adjustment holes 174, 176, 178, 180 depending upon the desired height of the chair seat 18.

To assemble the jumper apparatus 10 in accordance with the present invention, the caregiver simply inserts the end portions 56, 58 into the central aperture 46 of the respective head and foot portions 36, 38 of the base leg 14. The caregiver then aligns the chair seat 18 so that the front side 78 of the frame 70 faces toward the end portions 56, 58 of the seat-support leg 16. At this time, each connector 28, 30, 32, 34 should be aligned with one of the keyhole-shaped mounting slots 124 formed through the outer edge 76 of the chair frame 70. Once the connectors 28, 30, 32, 34 and the keyhole-shaped mounting slots 124 are aligned, the caregiver must simply grasp the second opposite end 128 of one of each of the extensible cords 20, 22, 24, 26 and stretch it so that it extends through the aligning inserting passageway 150 of the keyhole-shaped mounting slots 124. The cord 20 may then be released so that one end 140 of the retaining ring 138 will extend through the ring passageway 152 and the flange 144 will securely engage the frame 70.

To use the now assembled jumper apparatus 10, the caregiver must simply press the locking tabs 172 on both the head and the foot portions 36, 38 of the base leg 14 towards the central aperture 166. At this time, the height of the chair seat 18 is adjusted until the chair seat 18 is positioned such that the feet of the child (not shown) will just touch the ground when the chair seat 10 is stationary. The caregiver then places the child through the aperture 82 in the frame 70 and into the fabric seat 88 portion so that the child faces the activity bar 86. By exerting intermittent downward pressure of the child's feet on the surface (not shown), the child may repeatedly bounce the seat at a repetition rate having natural frequency and period determined, in part, by the weight of the child and, also in part, by the resiliency of the extensible cords 20, 22, 24, 26.

Although the invention has been described in detail with reference to certain preferred embodiments, variations and modifications exist within the scope and spirit of the invention as described and defined in the following claims.

What is claimed is:

1. A stationary baby jumper apparatus comprising a support frame having a base and a cantilevered seat support mounted upon the base and positioned to lie generally in an elevated horizontal plane, a chair seat including a frame, connectors positioned in spaced-apart relation to one another about the cantilevered seat support of the support frame, and cords having a first end, an opposite second end, and an extensible middle portion extending between the opposite first and second ends, the first end of each cord being coupled to one of the connectors and the opposite second end being coupled to the frame of the chair seat so that the cords and the frame of the chair seat are generally situated adjacent the seat support in the elevated horizontal plane.

2. The jumper apparatus of claim 1, wherein the base of the support frame includes foot and head portions positioned to lie vertically below the elevated horizontal plane and the seat support includes an end portion coupled to the foot portion of the base and an opposite end portion coupled to the head portion of the base and the opposite end portions of the seat support extend from the elevated horizontal plane towards the foot and head portions.

3. The jumper apparatus of claim 2, wherein the base has a curved shaft interconnecting the head and foot portions, the curved shaft of the base lies in a first horizontal plane, and the seat support is elevated to lie in the elevated horizontal plane vertically above and substantially parallel to the first horizontal plane and the connectors each include a sleeve portion and an opposite gripping portion, and the sleeve and opposite gripping portions are each positioned to lie generally in the elevated horizontal plane.

4. The jumper apparatus of claim 3, wherein the foot and head portions of the base include upstanding ends extending from the first horizontal plane towards the elevated horizontal plane.

5. The jumper apparatus of claim 2, further comprising means for adjusting the elevated vertical positioning of the seat support, frame, and cords relative to the base.

6. The jumper apparatus of claim 1, wherein at least one of the connectors includes a sleeve portion and an opposite gripping portion, the seat support extends through the sleeve portion, and at least one of the extensible cords extends into the gripping portion and the sleeve portion and the gripping portion are positioned to lie generally in the elevated horizontal plane.

7. The jumper apparatus of claim 6, wherein the gripping portion is formed to include a rim defining an aperture therethrough, the first end of at least one of the cords projects through the aperture and into at least one of the connectors and forms a bulb having a size greater than the diameter of the rim so that the first end of the extensible cord is securely fastened with the connector.

8. The jumper apparatus of claim 7, wherein the first end of the cord is folded upon the middle portion to form a looped portion of the bulb.

9. The jumper apparatus of claim 7, further comprising means for fastening the first end of the cord upon the middle portion to form the bulb.

10. The jumper apparatus of claim 9, wherein the fastening means is an end clip extending about the cord.

11. The jumper apparatus of claim 7, wherein the frame of the chair seat is formed to include a lip defining a cord-mounting slot and the second end of the extensible cord extends through the slot and forms a second bulb having a size greater then the diameter of the lip so that the second end of the extensible cord is fastened to the chair seat and the lip is positioned to lie generally in the elevated horizontal plane.

12. The jumper apparatus of claim 11, wherein the second end of the cord is folded upon the middle portion to form a looped portion of the second bulb.

13. The jumper apparatus of claim 12, wherein a clamp is positioned about the looped portion to fasten the second end against the middle portion.

14. The jumper apparatus of claim 11, further comprising means for fastening the second end of the cord upon the middle portion.

15. A stationary baby jumper apparatus comprising a support frame having a base and a cantilevered seat support mounted upon the base and positioned to lie generally in an elevated plane vertically above the base, a chair seat including a frame having an outward side, an opposite inward side, and an outer edge extending between the outward and inward sides, the outer edge being formed to include a plurality of lips defining cord-mounting slots positioned in spaced-apart relation to one another, connectors positioned in spaced-apart relation to one another about the seat support of the support frame, each connector including a sleeve portion formed for extension of the seat support therethrough, an opposite cord gripping end having a rim defining an aperture therethrough, and at least one wall extending between the sleeve portion and the gripping end to define a cavity, and cords having a first end, an opposite second end, and an extensible middle portion extending between the opposite first and second ends, the first end of each cord extending through the aperture of one connector and forming a first bulb having a size greater than the diameter of the rim and the opposite second end of each cord extending through the cord-mounting slot of the chair seat and forming a second bulb having a size greater than the diameter of the lip so that the seat frame is suspended from the seat support and positioned to lie substantially adjacent to the seat support in the elevated plane.

16. A stationary baby jumper apparatus comprising a support frame having a base and a cantilevered seat support mounted upon the base, a chair seat including a frame having an outward side, an opposite inward side, and an outer edge extending between the outward and inward sides, the outer edge being formed to include a plurality of lips defining cord-mounting slots positioned in spaced-apart relation to one another, connectors positioned in spaced-apart relation to one another about the seat support of the support frame, each connector including a sleeve portion formed for extension of the seat support therethrough, an opposite cord gripping end having a rim defining an aperture therethrough, and at least one wall extending between the sleeve portion and the gripping end to define a cavity, cords having a first end, an opposite second end, and an extensible middle portion extending between the first and second opposite ends, the first end of each cord extending through the aperture of one connector and forming a first bulb having a size greater than the diameter of the rim and the opposite second end of each cord extending through the cord-mounting slot of the chair seat and forming a second bulb having a size greater than the diameter of the lip so that the seat frame is suspended from the seat support substantially adjacent thereto, and means for blocking sliding movement of the connectors on the seat support.

17. The jumper apparatus of claim 16, wherein four connectors are positioned on the seat support, the outer edge of the frame is formed to include four cord-receiving slots therethrough, and four extensible cords extend between the connectors and through the cord-receiving slots.

18. The jumper apparatus of claim 16, wherein the blocking means includes screws extending through the seat support in spaced-apart relation to one another.

19. The jumper apparatus of claim 16, wherein the blocking means are situated on the seat support between the connectors.

20. The jumper apparatus of claim 15, wherein the second end of the cord is folded upon the middle portion to form a looped portion of the second bulb and the middle portion extends between the first and second bulbs and is positioned to lie generally in the elevated plane.

21. The jumper apparatus of claim 20, wherein a clamp is positioned about the looped portion to fasten the second end against the middle portion.

22. The jumper apparatus of claim 15, wherein the first end of the cord projects through the aperture into the cavity and the first bulb has a size greater than the diameter of the rim so that first end of the extensible cord is securely fastened within the connector.

23. The jumper apparatus of claim 22, wherein the first end of the cord is folded upon the middle portion to form a looped portion of the bulb.

24. The jumper apparatus of claim 23, further comprising means for fastening the first end of the cord upon the middle portion.

25. The jumper apparatus of claim 15, further comprising means for adjusting the vertical positioning of the seat support relative to the base.

26. A stationary baby jumper apparatus comprising a support frame having a base positioned to lie in a first horizontal plane and a cantilevered seat support mounted upon the base and positioned to lie generally in an elevated second horizontal plane vertically above the first horizontal plane, a chair seat having a frame formed to include lips defining cord-mounting slots positioned in spaced-apart relation to one another, connectors positioned in spaced-apart relation to one another about the seat support of the support frame, each connector including a cord gripping end having a rim defining an aperture therethrough, and cords extending between the frame and the respective connectors and being positioned to lie generally in the elevated second horizontal plane, the cords having a first end, an opposite second end, and an extensible middle portion extending between the opposite first and second ends, the first end of each cord extending through the aperture of one connector and folding upon the middle portion to form a first bulb having a size greater than the diameter of the rim, and the opposite second end of each cord extending through the cord-mounting slot of the chair seat and folding upon the middle portion to form a second bulb having a size greater than the diameter of the lip so that the seat frame is suspended from the seat support substantially adjacent thereto.

27. The jumper apparatus of claim 26, further comprising a first end clip wrapped about the first bulb, a second end clip wrapped about the second bulb, and a retaining ring extending into the cord-mounting slot and having a diameter sized to prevent sliding movement of the second bulb therethrough.

28. A stationary baby jumper apparatus comprising a support frame including a base, a pair of upright posts coupled to the base, and a seat support cantilevered to the pair of upright posts to lie in a horizontal plane above the base and formed to include an interior region, a child seat having a frame, and elongated flexible support members, each flexible support member having a first end coupled to the seat support and a second end coupled to the frame of the child seat, the flexible support members cooperating to suspend the frame of the child seat in the interior region above the base of the support frame generally in the horizontal plane of the support frame and to support limited movement of the child seat relative to the seat support so that the child seat is movable from the horizontal plane relative to the seat support upon movement of a child seated in the child seat relative to the support frame.

29. The jumper apparatus of claim 28, wherein each flexible support member includes a cord having opposite ends, a frame connector coupled to one end of the cord and the seat support, and a seat connector coupled to another end of the cord and the child seat and the frame connector and the seat connector are positioned to lie generally in the horizontal plane.

30. The jumper apparatus of claim 28, wherein the base is arch-shaped and includes a first end portion coupled to a first of the upright posts, a second end portion coupled to a second of the upright posts, and an arcuate portion interconnecting the first and second end portions.

31. The jumper apparatus of claim 30, wherein the base is defined by an arch-shaped tubular member.

32. The jumper apparatus of claim 30, wherein the first and second upright posts are arranged to lie in spaced-apart parallel relation.

33. The jumper apparatus of claim 32, wherein the seat support is arch-shaped and includes a first end portion coupled to the first upright post, a second end portion coupled to the second upright post, and an arcuate portion positioned to lie generally in the horizontal plane and interconnecting the first and second end portions of the seat support.

34. The jumper apparatus of claim 33, wherein the base has an arch shape matching an arch shape of the seat support.

35. The jumper apparatus of claim 33, wherein the seat support is defined by an arch-shaped tubular member.

36. The jumper apparatus of claim 33, wherein the arch-shaped seat support is positioned by the first and second upright posts to lie in spaced-apart parallel relation to the underlying arch-shaped base.

37. The jumper apparatus of claim 33, wherein a first of the flexible support members is coupled to the first end portion of the seat support, a second of the flexible support members is coupled to the arcuate portion of the seat support, and a third of the flexible support members is coupled to the second end portion of the seat support and the first, second, and third flexible support members are positioned to lie generally in the horizontal plane.

38. The jumper apparatus of claim 37, wherein a fourth of the flexible support members is also coupled to the arcuate portion of the seat support and arranged to lie between and in spaced-apart relation to the second and third flexible support members.

39. The jumper apparatus of claim 28, wherein the seat support is arch-shaped and includes a first end portion, a second end portion, and an arcuate portion positioned to lie generally in the horizontal plane and interconnecting the first and second end portions.

40. The jumper apparatus of claim 39, wherein a first of the flexible support members is coupled to the first end portion of the seat support, a second of the flexible support members is coupled to the arcuate portion of the seat support, and a third of the flexible support members is coupled to the second end portion of the seat support and the first, second, and third flexible support members are positioned to lie generally in the horizontal plane.

41. The jumper apparatus of claim 40, wherein a fourth of the flexible support members is also coupled to the arcuate portion of the seat support and arranged to lie between and in spaced-apart relation to the second and third flexible support members.

42. The jumper apparatus of claim 39, wherein the base has an arch shape matching the shape of the arch-shaped seat support.

43. The jumper apparatus of claim 39, wherein a first of the upright posts and a first of the flexible support members are coupled to the first end portion of the seat support, a second of the upright posts and a second of the flexible support members are coupled to the second end portion of the seat support, and a third of the flexible support members is coupled to the arcuate portion of the seat support and the first, second, and third flexible support members are positioned to lie generally in the horizontal plane.

44. The jumper apparatus of claim 43, wherein the first and second upright posts are arranged to lie in spaced-apart parallel relation.

45. The jumper apparatus of claim 28, wherein the child seat further includes a child-receiving seat member coupled to the frame and each of the flexible support members is coupled to the seat support and to the frame to support the frame generally in the horizontal plane for limited movement relative to the support frame.

46. The jumper apparatus of claim 45, wherein the seat support is arch-shaped and includes a first end portion coupled to a first of the upright posts, a second end portion coupled to a second of the upright posts, and an arcuate portion interconnecting the first and second end portions of the seat support, a first of the flexible support members is coupled to the frame and to the first end portion of the seat support, a second of the flexible support members is coupled to the frame and to the arcuate portion of the seat support, and a third of the flexible support members is coupled to the frame and to the second end portion of the seat support and the first, second, and third flexible support members are positioned to lie generally in the horizontal plane.

47. The jumper apparatus of claim 46, wherein a fourth of the flexible support members is also coupled to the frame and to the arcuate portion of the seat support and is arranged to lie between and in spaced-apart relation to the second and third flexible support members.

48. The jumper apparatus of claim 46, wherein each of the flexible support members is aligned to lie in radially outwardly extending directions between the frame and the seat support.

49. The jumper apparatus of claim 48, wherein the frame is round.

50. The jumper apparatus of claim 28, wherein a first of the upright posts includes a first shaft appended to the base and a second shaft appended to the seat support and telescopically engaged to the first shaft to enable relative movement between the first and second shafts to move the seat support relative to the underlying base between raised and lower elevation positions and further comprising a shaft lock mechanism engaged to the first and second shafts and configured to fix the second shaft in a selected position relative to the first shaft to set the elevation of the seat support above the base.

51. A stationary baby jumper apparatus comprising a support frame including a base positioned to lie in a first horizontal plane and a seat support, the seat support includes an arch-shaped tube, a first elbow tube having a first end coupled to the arch-shaped tube and a second end coupled to the base, a second elbow tube having a first end coupled to the arch-shaped tube and a second end coupled to the base, the arch-shaped tube of the seat support being positioned to lie above the base in a second horizontal plane that is substantially parallel to the first horizontal plane and formed to include an interior region, a child seat having a frame, and a plurality of elongated flexible support members, a first of the flexible support members having a first end coupled to the seat support at a junction between the arch-shaped tube and the first elbow tube and a second end coupled to the child seat, a second of the flexible support members having a first end coupled to the seat support at a junction between the arch-shaped tube and the second elbow tube and a second end coupled to the child seat, and a third of the flexible support members having a first end coupled to the arch-shaped tube at a first point between the first and second elbow tubes, the flexible support members cooperating to suspend the frame of the child seat above the base of the support frame in generally the second horizontal plane and to permit limited movement of the child seat relative to the seat support upon movement of a child seated in the seat relative to the support frame.

52. The jumper apparatus of claim 51, wherein each flexible support member includes a cord having opposite ends, a frame connector coupled to one end of the cord and the seat support, and a seat connector coupled to another end of the cord and the child seat and the cord is positioned to lie generally in the second horizontal plane.

53. The jumper apparatus of claim 51, wherein a fourth of the flexible support members is coupled to the arch-shaped tube at a second point located between the first point and the second elbow tube and is arranged to lie in between and in spaced-apart relation to the second and third flexible support members and the flexible support members are positioned to lie generally in the second horizontal plane.

54. The jumper apparatus of claim 51, wherein the base includes a first upright shaft coupled in telescoping relation to the second end of the first elbow tube of the seat support to enable relative movement between the first upright shaft and the first elbow tube to move the seat support relative to the underlying base between raised and lowered elevated positions and further comprising a first shaft lock mechanism engaged to the first upright shaft and the first elbow tube and configured to fix the first elbow tube in a selected position relative to the first upright shaft to set the elevation of the seat support above the base.

55. The jumper apparatus of claim 54, wherein the base includes a second upright shaft coupled in telescoping relation to the second end of the second elbow tube of the seat support to enable relative movement between the second upright shaft and the second elbow tube and further comprising a second shaft lock mechanism engaged to the second upright shaft and the second elbow tube and configured to fix the second elbow tube in a selected position relative to the second upright shaft.

56. The jumper apparatus of claim 55, wherein the first and second upright shafts of the base are arranged to lie in spaced-apart parallel relation.

57. A stationary baby jumper apparatus comprising a support frame having a base positioned to lie generally in a horizontal plane and a cantilevered seat support mounted upon the base, a chair seat including a circular-shaped frame having apertures therethrough, connectors positioned in spaced-apart relation to one another about the cantilevered seat support of the support frame, and cords having a first end, an opposite second end, and an extensible middle portion extending between the opposite first and second ends, the first end of each cord being coupled to one of the connectors and the opposite second end extending through one of the apertures and being coupled to the frame of the chair seat, each of the cords extending between the connectors and the chair seat in an orientation that is generally horizontal.

* * * * *